US010472862B2

(12) United States Patent
Barron

(10) Patent No.: US 10,472,862 B2
(45) Date of Patent: Nov. 12, 2019

(54) SECURITY LOCKS

(71) Applicant: Zeal Innovation Ltd., Swansea (GB)

(72) Inventor: Neil Anthony Barron, Swansea (GB)

(73) Assignee: Zeal Innovation Ltd., Swansea (GB)

( * ) Notice: Subject to any disclaimer, the term of this patent is extended or adjusted under 35 U.S.C. 154(b) by 115 days.

(21) Appl. No.: 15/522,709

(22) PCT Filed: Oct. 28, 2015

(86) PCT No.: PCT/GB2015/053234
§ 371 (c)(1),
(2) Date: Apr. 27, 2017

(87) PCT Pub. No.: WO2016/067026
PCT Pub. Date: May 6, 2016

(65) Prior Publication Data

US 2017/0314295 A1 Nov. 2, 2017

(30) Foreign Application Priority Data

Oct. 28, 2014 (GB) ..... 1419152.2

(51) Int. Cl.
*E05B 73/00* (2006.01)
*E05B 67/02* (2006.01)
(Continued)

(52) U.S. Cl.
CPC ..... *E05B 73/0005* (2013.01); *E05B 67/003* (2013.01); *E05B 67/02* (2013.01);
(Continued)

(58) Field of Classification Search
CPC ..... E05B 73/0011; E05B 67/006; E05B 73/0005; E05B 67/02; E05B 67/003; E05B 65/52; E05B 2009/004; E05C 19/06
(Continued)

(56) References Cited

U.S. PATENT DOCUMENTS 616,647 A * 12/1898 Woodward
1,394,673 A 10/1921 Doyle
(Continued)

FOREIGN PATENT DOCUMENTS

| | | |
|---|---|---|
| FR | 2566824 | 1/1986 |
| GB | 800955 | 9/1958 |
| WO | WO 2015/087067 | 6/2015 |

OTHER PUBLICATIONS

PCT International Search Report and Written Opinion dated Feb. 19, 2016 issued in PCT Application No. PCT/GB2015/053234.
(Continued)

*Primary Examiner* — Lloyd A Gall
(74) *Attorney, Agent, or Firm* — Weaver Austin Villeneuve & Sampson LLP

(57) ABSTRACT

A lock comprises a male element, and a female element for receiving the male element enabling aligned copular engagement. The male element has a shoulder and the female element a catch for closing behind the shoulder to hold the male element therein. The catch and a lock casing are held in the female element with the axis of the lock casing inclined, normally at a right angle, to the line of engagement of the male and female elements. The lock casing and the female element have juxtaposed faces inclined to the line of engagement of the male and female elements. At least one face on the lock casing extends from the casing outwardly from the line of engagement contiguous with an inwardly facing complementary face on the female element. In this way longitudinal forces generated by attempted separation of the engaged male and female elements are resolved by the faces into a lateral force on the female element.

17 Claims, 3 Drawing Sheets

(51) Int. Cl.

| | |
|---|---|
| ***E05B 67/00*** | (2006.01) |
| *E05B 65/52* | (2006.01) |
| *E05C 19/06* | (2006.01) |
| *E05B 9/00* | (2006.01) |

(52) U.S. Cl.
CPC ..... *E05B 65/52* (2013.01); *E05B 2009/004* (2013.01); *E05C 19/06* (2013.01)

(58) Field of Classification Search
USPC ..... 70/14, 18, 30, 49, 58, 233; 292/340, 341
See application file for complete search history.

(56) References Cited

U.S. PATENT DOCUMENTS 1,512,915 A * 10/1924 Edelson ..... E05B 17/2088 70/104
1,681,409 A * 8/1928 Johnson ..... B62D 43/007 152/237
1,921,434 A * 8/1933 Stone ..... B62D 43/007 70/14
2,689,758 A * 9/1954 Orr ..... E05B 85/22 16/82
3,435,642 A 4/1969 Del Pesco
3,696,647 A * 10/1972 Balicki ..... E05B 67/003 70/417
3,765,196 A * 10/1973 Balicki ..... E05B 67/003 70/18
3,789,638 A 2/1974 Ward et al.
4,098,099 A * 7/1978 Smith ..... B62H 5/003 70/18
4,109,495 A 8/1978 Roberts
4,226,100 A * 10/1980 Hampton ..... E05B 17/002 70/51
4,404,822 A * 9/1983 Green ..... B62H 5/003 224/413
5,092,142 A * 3/1992 Zane ..... E05B 67/063 70/233
5,291,761 A * 3/1994 Lii ..... B62H 5/003 70/18
5,367,785 A * 11/1994 Benarroch ..... E05B 67/006 33/755
5,447,043 A 9/1995 Hwang
5,587,702 A 12/1996 Chadfield
6,233,985 B1 5/2001 Huang
6,263,711 B1 7/2001 Kuo
6,341,509 B1 * 1/2002 McDaid ..... E05B 9/084 70/371
6,386,005 B1 5/2002 Kuo
2004/0055342 A1 * 3/2004 Chen ..... E05B 17/002 70/56
2004/0183317 A1 * 9/2004 Kihara ..... A45C 13/1084 292/340
2009/0025433 A1 1/2009 Evans
2014/0020436 A1 1/2014 Matuschek

OTHER PUBLICATIONS

GB Search Report dated May 1, 2015 issued in GB Application No. GB1419152.2.

* cited by examiner

SECURITY LOCKS

CROSS-REFERENCE TO RELATED APPLICATIONS

The present application claims priority under 35 U.S.C § 371 to International Application No. PCT/GB2015/053234, the entire disclosure of which is incorporated herein by reference for all purposes.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

Field of the Invention

This invention relates to security devices, and particularly to locks for chains or straps designed to secure property. It has especial, but not exclusive application to locks for cycles and motorcycles. Locks of the invention can be used in device of the kind described in our International Patent publication No. WO2015/087067, the disclosure whereof is hereby incorporated by reference.

Description of Related Art Including Information Disclosed Under 37 CFR 1.97 and 1.98

A great number of designs of locks for security devices have been proposed, including many for chains or straps used in securing cycles and motorcycles, gates and luggage. Chain locks typically use a padlock for coupling the links at the end of the chain, but some couple the chain ends to matching lock components, which are also used in strap locks, for locking engagement. Examples of cable locks are disclosed in U.S. Pat. Nos. 3,435,642 and 6,263,711, the disclosures whereof are hereby incorporated by reference. The present invention is directed particularly at strap, cable or chain locks, but also has more general application.

BRIEF SUMMARY OF THE INVENTION

According to the present invention a lock comprises a male element, and a female element for receiving the male element enabling aligned copular engagement. The male element has a shoulder and the female element a catch for closing behind the shoulder to hold the male element therein.

The catch and a lock casing are held in the female element with the axis of the lock casing inclined, normally at a right angle, to the line of engagement of the male and female elements. The lock casing and the female element have juxtaposed faces inclined to the line of engagement of the male and female elements. At least one face on the lock casing or female element extends from the casing outwardly from the line of engagement contiguous with an inwardly facing complementary face on the female element or lock casing respectively. In this way longitudinal forces generated by attempted separation of the engaged male and female elements are resolved by said faces into a lateral force on the female element or the lock casing. In most embodiments there will be at least two pairs of juxtaposed faces to create a dovetail effect and thus outward lateral forces in opposite senses, and preferably there will be a dovetail at each of two opposite ends of the lock casing. Alternatively, or additionally, one or more such faces may be formed on the outer (relative to the line of engagement) surface of the lock casing wholly received in the female element, or on projections extending from one or both ends of the lock casing.

The casing has an axis, and a mechanism in the lock casing is operable on that axis to selectively displace the catch to engage or release the male element. Thus when engaged, the male and female elements, and the ends of a chain or strap to which they are coupled are connected in line. A key can be inserted in the lock casing along its axis, for moving the latch to release or admit the male element. However, alternative mechanisms such as a coded keypad, an electromechanical actuator or a wireless link can be used to effect movement of the catch. The catch will normally be resilient, with one of the catch and the male element having at least one chamfer to facilitate engagement, and avoid the need to positively close the latch behind the shoulder of the male element.

The female element can be reinforced to resist lateral forces generated by attempted separation of the engaged male and female elements by a housing or sleeve enclosing both the female element and the lock casing. If dovetails are formed on the female element the consequential expansive forces act on the lock casing and this will normally require reinforcement which can also be provided by a housing or sleeve. This arrangement provides some protection for the female element, but risks the expansive forces serving to disengage the latch, and as the casing will normally be of a material less resilient than that of the female element, the former is preferred.

The female element in a lock according to the invention is typically formed in two parts. The inclination of the inclined faces of the lock casing and the female element is preferably such that longitudinal forces generated by attempted separation of the elements are resolved on the female element in an expansive manner as discussed above and serve to urge the parts apart. While the parts can be secured so as to resist these resolved forces, the female element may be enclosed in a housing or sleeve to provide reinforcement as described above. Either or both of these features may be adopted. The reactive forces on such a casing are compressive and thereby serve to hold the lock casing in place and secure its installation in the female element.

In many embodiments of the invention the male element will have a polygonal, normally square, cross section. However a circular or any other suitable cross section can be used. Particularly when the latch is resilient, its tip may be formed with one or more chamfers to facilitate its engagement with or without a key. Where its cross section is polygonal, a chamfer can be formed on at least two, normally opposite sides. Of course if preferred, one or more chamfers can be formed on the latch as an alternative or in addition to that or those on the male element.

When used as part of a security chain or strap the male and female elements of the lock are attached to the respective ends of the chain or strap. The chain or strap can then be used to secure an item to a fixture for example, or to immobilize a vehicle such as a cycle or motorcycle. It could also be used to securely close a suitcase or packing case. The lock itself can also be used alone to secure suitcases or packing cases, or indeed closures more generally such as doors, cupboards and boxes.

BRIEF DESCRIPTION OF THE SEVERAL VIEWS OF THE DRAWING(S)

Embodiments of the invention will now be described by way of example and with reference to the accompanying schematic drawings, wherein.

Figure 2:
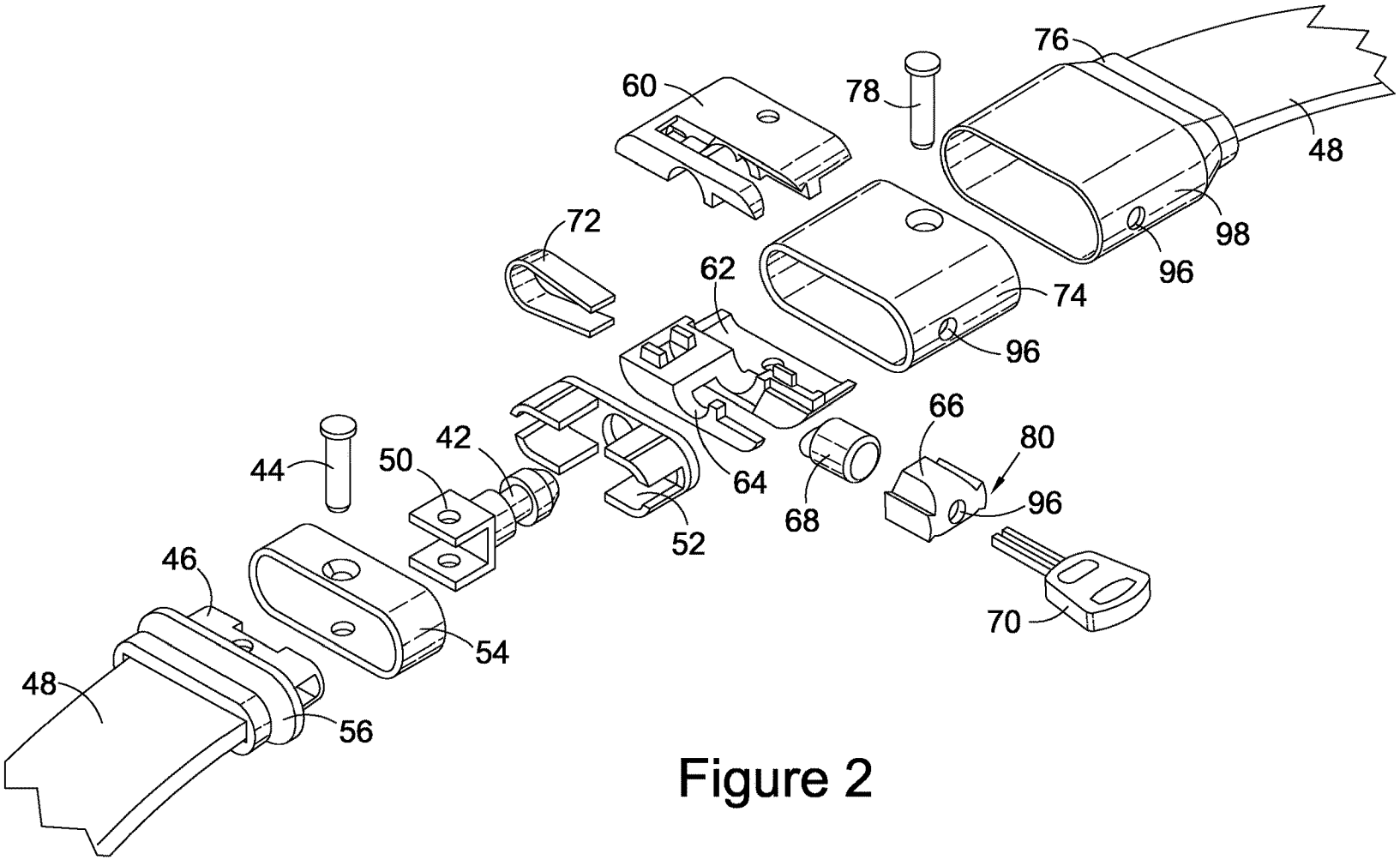
FIG. 2 is a part exploded perspective view of a lock according to a second embodiment of the invention showing its attachment to the ends of a security strap.
Figure 3A:
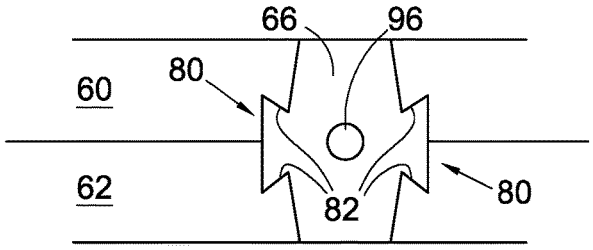
Figure 3B:
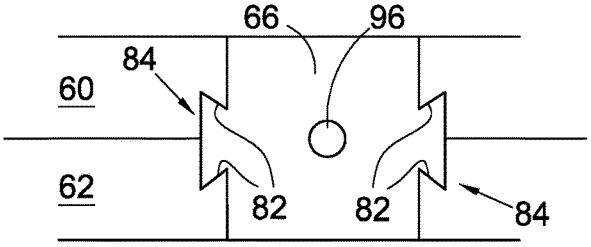
Figure 3C:
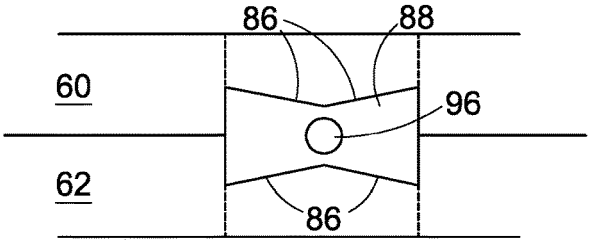
Figure 3D:
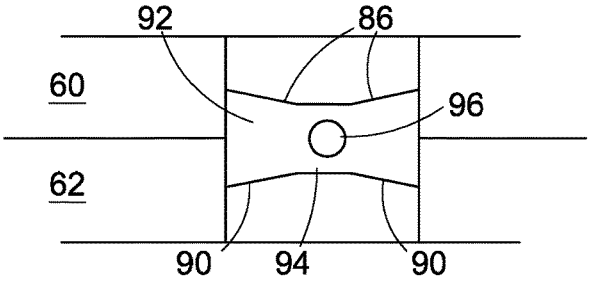
Figure 4:
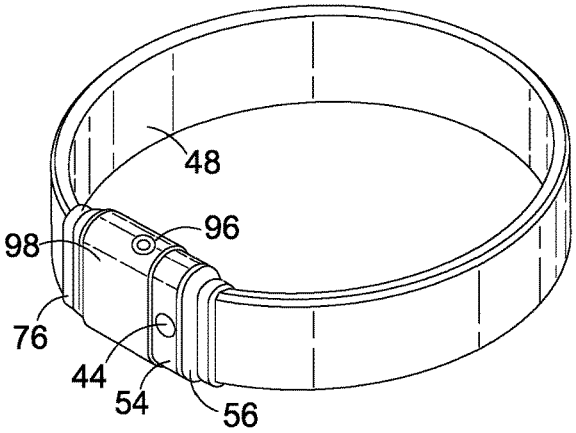

FIG. 3 FIGS. 3A-3D illustrates alternative installations of the lock casing in the female element; and FIG. 4 shows a perspective view of a security strap including a lock of the kind shown in FIG. 2.

DETAILED DESCRIPTION OF THE INVENTION

Figure 1:
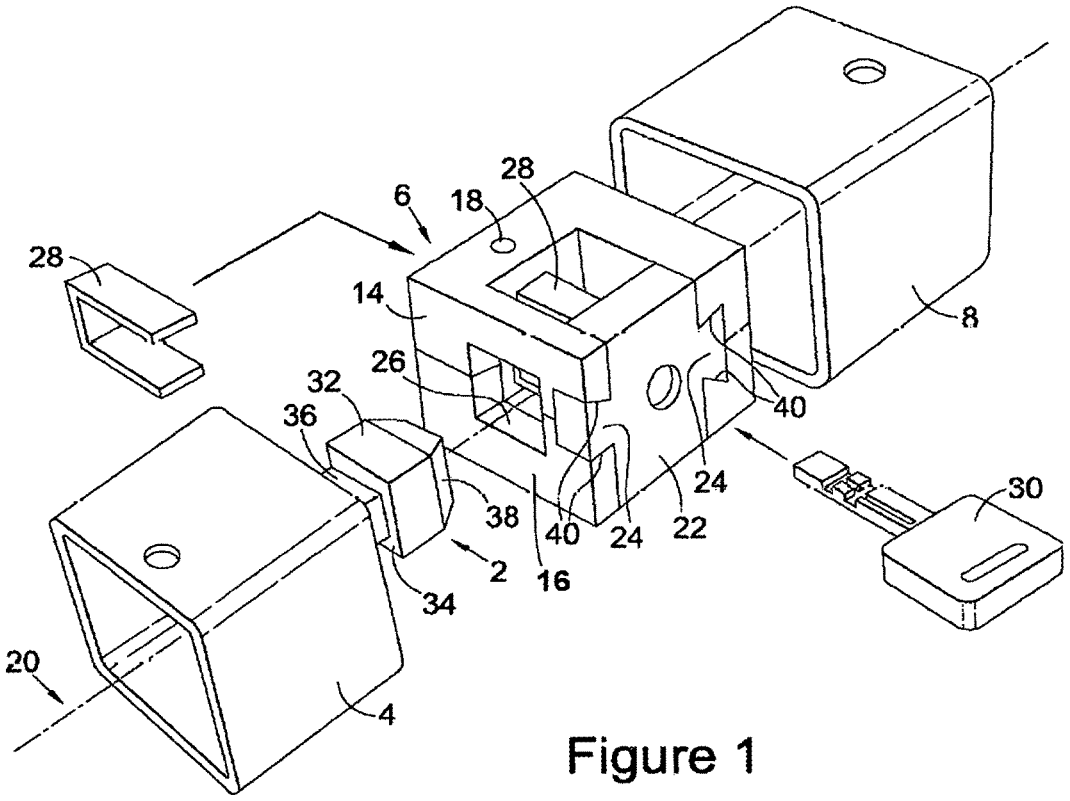
FIG. 1 shows in an exploded view the principle components of a lock to be assembled in accordance with a first embodiment of the invention.

As shown in FIG. 1 a male element 2 projects from a coupling 4 adapted for attachment to one end of a cable, chain or strap (not shown). The male element is arranged to be received in a female element 6 which is itself intended to be received in a sleeve 8. The sleeve with the female element form a second coupling adapted for attachment to the other end of the cable, chain or strap. It will though, be appreciated that the two couplings could readily be adapted for attachment to any two units which are to be locked together such as a door and frame, or lid and container.

The female element 6 illustrated consists of two complementary matching parts 14, 16 each in the form of a C-section and held together by one or more rivets or screws. One is shown, identified at 18, on one side of the line of engagement, indicated at 20, of the male and female elements. On the other side of the line of engagement a lock casing 22 is fitted, filling the space between and holding together the distal ends of each C-section part (14, 16). The casing 22 is formed with a dovetail 24 at each end extending in the direction of the line of engagement 20 and fitting an a complementary groove formed by the matching parts 14, 16 of the female element 6. As can be seen, the parts 14, 16 complete the periphery of an opening 26 through which the male part is received.

In the arrangement shown, when an attempt is made to separate the engaged elements, the inclined surfaces 40 of the dovetails on the casing 22 resolve the longitudinal forces into expansive forces on the female element 6 urging the parts 14, 16 to separate. These are resisted by the parts themselves and their assembly, and also by the sleeve 8. The reactive forces on the dovetails are compressive, and serve to enhance the secure retention of the casing 22 in the female element 6. As can be seen, the casing 22 is a flush fit in the female element 6, as is the female element and casing combination in the sleeve 8.

A catch 28 is held within the female element 6 in the space defined by the matching parts 14, 16. It can be installed from the one side of the line of engagement 20 as indicated. It can be displaced or deflected by operation of a key 30 extended through the casing 22 which engages a cam (not shown) at the inner boundary of the lock casing 22. The key is cut with projections matching recesses in a lock cylinder (also not shown) in the lock casing enabling it to turn the cam and thereby separate the legs of the catch and release, or allow access to, the male element 2 in a conventional manner. Suitable locking mechanisms are disc locks of the kind described in U.S. Pat. Nos. 3,789,638 and 4,109,495, the disclosures whereof are hereby incorporated by reference. Such locks are available from Abloy Oy of Joensuu, Finland The male element 2 has an enlarged tip 32 of substantially square cross section defining a shoulder 34 relative to its stem 36 which links it to the coupling 4. At its distal end the tip 32 is formed with chamfers 38 to facilitate its passage and latching engagement past the catch 28. It will be appreciated that one or more appropriate chamfers may be formed on the catch 28 rather than on the male element tip, but the arrangement shown is preferred.

When ready for use, the female element 6 is housed in the sleeve 8 which is normally formed in hardened steel which prevents cutting and protects the assembly as a whole from impact tools that might damage the element and particularly the lock casing 22 and latch 28, while also providing reinforcement for the female element 6 as discussed above. The coupling 4 from which the male element 2 projects is also normally formed in hardened steel to match the sleeve 8 such that when coupled the lock forms a rectanguloid block. When used to couple the ends of a chain or strap, the coupling 4 and sleeve 8 will be adapted to receive and be permanently attached to those ends. Steel will also normally be used for the other components of the lock, but as they are less exposed the same level of hardening is not usually necessary.

In the lock shown in FIG. 2 the male element 42 projects from a coupling attached by a pin 44 to one end 46 of a strap 48. The male element 42 is of round cross-section rather than square as is the element 2 of FIG. 1, but otherwise substantially similar. The coupling comprises a C-section mount 50, a cowling 52 and first and second collars 54, 56. The pin 44 and the first collar 54 are formed in hardened steel to protect the coupling 50. The strap end 48 is clamped and adhesively secured in the second collar 56 with its end 46 projecting therefrom. When assembled the end 46 is received in the first collar 54 which abuts against the second collar 56, and a pin 44 extends through the first collar 54, the C-section mount 50 and the strap end 46 to complete the attachment. As described below, the coupling can be enclosed within an outer cover when the lock is closed.

The female element in the embodiment of FIG. 2 is similar to that of FIG. 1 in that it comprises two complementary matching upper and lower parts 60 and 62. When assembled they form a cylindrical channel 64 for receiving the male element 42 and a perpendicular channel for receiving a lock casing 66. The female element parts and the lock casing are accurately machined to ensure a flush fit. A lock barrel 68 is held within the casing 66 for receiving a key 70 to selectively release a catch 72 installed in the assembled female parts 60, 62, and which extends across the cylindrical channel 64. Locks similar to those referred to above with reference to FIG. 1 can be used in this embodiment of the invention. The parts 60 and 62 are received and a flush fit in a sleeve 74, and can also be held together by screws or rivets, not shown. On the end opposite the channel 64 they form a recess for receiving the other end of the strap 48 which is held in a third collar 76 in a manner similar to that securing the one end 46 with a pin 78 extending through the sleeve 74 and the respective strap end. Additional mechanisms can be used to secure one or both ends of the parts 60, 62 in the sleeve 74.

The lock casing 66 is formed with two dovetail projections 80. An end view of the casing 66 is shown in FIG. 3A. As can be seen, the dovetails form inclined surfaces 82 in juxtaposition with matching surfaces on the upper and lower parts 60, 62 of the female element. As in the embodiment of FIG. 1, when an attempt is made to separate the engaged male and female elements, the inclined surfaces 82 resolve the longitudinal forces into expansive forces urging the parts 60 and 62 to separate. These are resisted by the parts themselves and their assembly, and also by the sleeve 74 which is formed in hardened steel for this purpose and to provide protection for the lock components. Similarly, the reactive forces on the dovetails are compressive, and serve to enhance the secure retention of the casing 66 between the parts 60 and 62.

FIG. 3B shows a similar arrangement to that of FIG. 3A, with the lock casing 66 having a little more bulk. The dovetails 84 are larger, and project from parallel faces at either end of the lock casing. This may be more suitable for a larger lock unit. FIGS. 3C and 3D show casings on which the inclined surfaces 86 and 90 respectively are formed directly on the upper and lower faces of the casings 88 and 92. In FIG. 3C the surfaces 86 extend the length of the casing 88 at least at the exposed end of the perpendicular channel in which the casing is received. The surfaces 86 do not have to extend the full depth of the casing 88 which will normally be enlarged as indicated by the dotted lines towards its other end to receive the lock barrel 68. In FIG. 3D the inclined surfaces at opposite ends of the casing 92 are spaced from one another by a section 94 surrounding the opening for receiving the key 70. Again, the surfaces 90 do not have to extend the full depth of the casing 92 which will also normally be enlarged as indicated towards its other end to receive the lock barrel 68. Indeed, the same applies to the arrangement of FIGS. 3A and 3B, and the embodiment of FIG. 1, although the arrangement selected will very much depend upon the eventual deployment of the assembled lock. It should also be noted that it is not essential that the inclined juxtaposed surfaces are created at both ends of the lock casing. Inclined faces at one end of the lock casing will generate the expansive forces on the female element as described above. It is though, preferred that the juxtaposed inclined faces are created at each end of the casing.

When the lock of FIG. 2 is assembled, the female parts 60 and 62, the lock casing 66 lock barrel 68 and catch 72 are wholly enclosed within the sleeve 74, and the coupling 50 within the first collar 54. This is apparent from FIG. 4 which shows a strap 48 with its two ends held together by a lock of the kind shown in FIG. 2. The strap may of course be replaced by a chain or cable, and the lock itself may be used to hold any two adjacent items together. A cover 98 extends over the sleeve 74, and may also extend over the first collar 54. With this extension, none of the components is exposed, and the only access is for the key 70 through the aligned keyholes 96 to the lock barrel 68.

While two specific embodiments have been described, it will be appreciated that features of one may be adopted in the other, as can the alternative arrangements of FIG. 3 be adopted in either.

The invention claimed is:

1. A lock for a security device comprising a male element having a shoulder and a female element for receiving the male element and having a catch enabling aligned copular engagement therebetween with the catch behind the shoulder; and a lock casing having an axis, the lock casing including a mechanism operable along said axis for selectively displacing the catch to engage or release the male element, the catch and lock casing being held in the female element with the axis of the lock casing crossing the line of engagement of the male and female elements, and wherein the lock casing and the female element have juxtaposed faces that form at least one dovetail joint whereby longitudinal forces generated by attempted separation of the engaged male and female elements are resolved by said faces into lateral forces on the female element.

2. A lock according to claim 1 wherein the lock casing comprises a body with two dovetails extending in opposite senses in the direction of said line of engagement.

3. A lock according to claim 1 wherein the juxtaposed faces are at the outer surface of the lock casing relative to the line of engagement of the male and female elements.

4. A lock according to claim 1 wherein the lock casing is held in the female element on one side of said line of engagement.

5. A lock according to claim 1 wherein the female element comprise two parts.

6. A lock according to claim 5 wherein the juxtaposed faces resolve longitudinal forces in a direction to separate the parts.

7. A lock according to claim 1 wherein the female element is confined in an outer sleeve.

8. A lock according to claim 1 wherein the axis of the lock casing is substantially perpendicular to said line of engagement.

9. A lock according to claim 1 wherein the male element has a polygonal cross section.

10. A lock according to claim 9 wherein the cross section of the male element is square.

11. A lock according to claim 1 wherein the male element has a circular cross section.

12. A lock according to claim 1 wherein the catch is resilient and one of the male and female elements has a chamfer to facilitate the latching engagement of the male and female elements.

13. A lock according to claim 1 including a key for operating the mechanism in the lock casing.

14. A security cable, chain or strap having a lock according to claim 1 wherein the male and female elements are attached to the respective ends of the cable, chain or strap.

15. A security device comprising a cable, chain or strap and a lock with male and female elements attached to the respective ends thereof, the lock having the male element with a shoulder and the female element for receiving the male element and having a catch enabling aligned copular engagement therebetween with the catch behind the shoulder; and a lock casing having an axis, the lock casing including a mechanism operable along the lock casing axis for selectively displacing the catch to engage or release the male element, the catch and lock casing being held in the female element with the axis of the lock casing crossing the line of engagement of the male and female elements, and wherein the lock casing and the female element have juxtaposed faces forming at least one dovetail joint, whereby longitudinal forces generated by attempted separation of the engaged male and female elements are resolved by said faces into lateral forces on the female element.

16. A security device according to claim 15 wherein the female element comprise two parts.

17. A security device according to claim 16 wherein the female element is confined in an outer sleeve, and wherein the juxtaposed faces of the lock casing and the female element resolve longitudinal forces in a direction to separate the parts.

* * * * *